US005097535A

United States Patent [19]

Dye et al.

[11] Patent Number: 5,097,535

[45] Date of Patent: Mar. 24, 1992

[54] GARMENT FOR USE IN HEALTH CARE SITUATIONS

[76] Inventors: Betty J. Dye, Rte. 3, Box 9; Steve Dillard, Rte. 2, Box 6, both of Blue Springs, Miss. 38828

[21] Appl. No.: 610,765

[22] Filed: Nov. 8, 1990

[51] Int. Cl.[5] ..... A41B 9/00; A41D 10/00

[52] U.S. Cl. ..... 2/69; 2/77; 2/83; 2/104; 2/113; 2/114; 2/115; 2/116; 2/125; 2/227; 2/DIG. 6; 2/DIG. 7

[58] Field of Search ..... 2/69, 104, 113, 83, 2/77, 114, 115, 116, 125, 126, 227, DIG. 7, DIG. 6

[56] References Cited

U.S. PATENT DOCUMENTS

| | | | |
|---|---|---|---|
| 3,824,625 | 7/1974 | Green | 2/114 |
| 4,055,855 | 11/1977 | Ragone et al. | 2/DIG. 7 |
| 4,549,315 | 10/1985 | English et al. | 2/227 |
| 4,570,268 | 2/1986 | Freeman | 2/114 |
| 4,638,509 | 1/1987 | Charron | 2/227 |
| 4,644,589 | 2/1987 | Pettis | 2/109 |
| 4,649,574 | 3/1987 | Michels | 2/235 |
| 4,683,594 | 8/1987 | Feinberg | 2/69 |
| 4,737,995 | 4/1988 | Wiley | 2/114 |
| 4,764,986 | 8/1988 | Stewart | 2/DIG. 7 |
| 4,914,756 | 4/1990 | Grassick | 2/DIG. 7 |
| 4,964,173 | 10/1990 | Gordon | 2/114 |
| 4,969,215 | 11/1990 | Burkett | 2/114 |
| 4,995,115 | 2/1991 | Ellis | 2/69 |

FOREIGN PATENT DOCUMENTS

| | | | |
|---|---|---|---|
| 44675 | 11/1908 | Sweden | 2/114 |
| 23779 | of 1893 | United Kingdom | 2/114 |
| 11480 | of 1895 | United Kingdom | 2/114 |

OTHER PUBLICATIONS

"Self-Adhering Nylon Tapes", Maurice Gershman, M.D., Journal of American Medical Assn., vol. 168, No. 7, 10-18-58; p. 930.

*Primary Examiner*—Werner H. Schroeder
*Assistant Examiner*—Gloria Hale
*Attorney, Agent, or Firm*—Terry M. Gernstein

[57] ABSTRACT

A garment resembles pajamas and includes a shirt which has openable sleeves and pants which have openable legs. The sleeves and legs are openable for the entire length thereof so some or all of the wearer's limbs and body can be exposed for providing health care to that wearer. The legs and arms can be closed to cover the wearer so the garment can be both aesthetically pleasing, warm and yet still provide access to the patient for the purposes of providing health care.

4 Claims, 13 Drawing Sheets

GARMENT FOR USE IN HEALTH CARE SITUATIONS

TECHNICAL FIELD OF THE INVENTION

The present invention relates to the general art of wearing apparel, and to the particular field of special clothing for use in the health care field.

BACKGROUND OF THE INVENTION

At one time or another, most people have undergone some sort of medical treatment which has required them to wear a so-called hospital gown. Such articles of clothing are generally shapeless drapes which are open tin the back, short sleeved and quite short in length. These gowns generally are disposable and include a waist band for closing the gown. While such structure is functional in that it permits health care providers access to the patient—the primary purpose of the clothing—it is generally uncomfortable to wear. As is well known, a patient's psychological outlook is often very important to the success of many health care procedures.

However, it is difficult to balance stylish appearance with the functional requirements of clothing intended to be worn in hospitals, doctors's examination rooms, and the like. For example, in some situations, patient care or treatment may require administering an IV to the patient. This procedure may be extended for several days, weeks or even longer in some cases. Since an IV set up must be attached to the patient, most often in an appendage of that patient, several problems may arise. Unless the patient's clothing is easily opened, removed and replaced, it may be difficult to change the patient's clothing, dressings, or the like with the IV set-up attached to that patient. It may also be difficult to bathe the patient. The staff members in most hcspitals do not have the time to spend with each patient to deal with tight-fitting or difficult-to-change clothing. Accordingly, the traditional hospital gown has been used.

Still further, many patients have sore limbs, casts or the like which require loose-fitting clothing during care. Again, a traditional hospital gown appears to be needed to achieve this result.

However, many patients find these traditional hospital gowns, not only displeasurable, but physically uncomfortable, especially if the environmental temperature in the room is lower than they are comfortable with.

Therefore, there is a need for an article of clothing which is intended to be worn in health care situations which is comfortable and aesthetically pleasing for the patient, yet which is still able to satisfy the functional requirements of the health care provider.

Heretofore, since most hospital gowns are distasteful to most individuals, they are generally only worn in the health care situation. Because of this consideration, and for medical reasons, most hospital gowns are designed to be worn only once and then discarded. The disposable nature of these gowns not only adds expense but reduces the aesthetic features of the clothing.

Therefore there is also a need for an article of clothing which is intended to be worn in health care situations which can be worn more than once, and which is conducive to multiple wearings by a patient.

OBJECTS OF THE INVENTION

It is a main object of the present invention to provide an article of clothing which is intended to be worn in health care situations which is comfortable and aesthetically pleasing for the patient.

It is another object of the present invention to provide an article of clothing which is intended to be worn in health care situations which is comfortable and aesthetically pleasing for the patient, yet which is still able to satisfy the functional requirements of the health care provider.

It is another object of the present invention to provide an article of clothing which is intended to be worn in health care situations which is comfortable and aesthetically pleasing for the patient, yet which is still able to satisfy the functional requirements of the health care provider, and which can be worn more than once, and which is conducive to multiple wearings by a patient.

SUMMARY OF THE INVENTION

These, and other objects are achieved by an article of clothing which is worn in health care situations that resembles pajamas, and which includes a shirt having sleeves and pants having legs, with the sleeves and the legs being adapted to be easily opened and closed whereby access to the patient's appendages is easy and expeditious. The sleeves and legs are closed by releasable fastener means, such as hook-and-loop fastener elements so a health care provider can gain access to the patient's arms or legs, or the patient can wear a cast or prevent clothing from contacting his skin if necessary. However, the legs and sleeves can be closed, and the garment will closely resemble regular pajamas, which can be styled and decorated in any suitable manner to fulfill the need to be aesthetically pleasing. The pajamas will also keep a patient warm since all his appendages can be covered.

Since the garment is aesthetically pleasing, it is conducive to multiple wearings, and thus can be used a plurality of times, even taken home and used in normal situations.

BRIEF DESCRIPTION OF THE DRAWING FIGURES

DETAILED DESCRIPTION OF THE PREFERRED EMBODIMENT OF THE INVENTION

Figure 1:
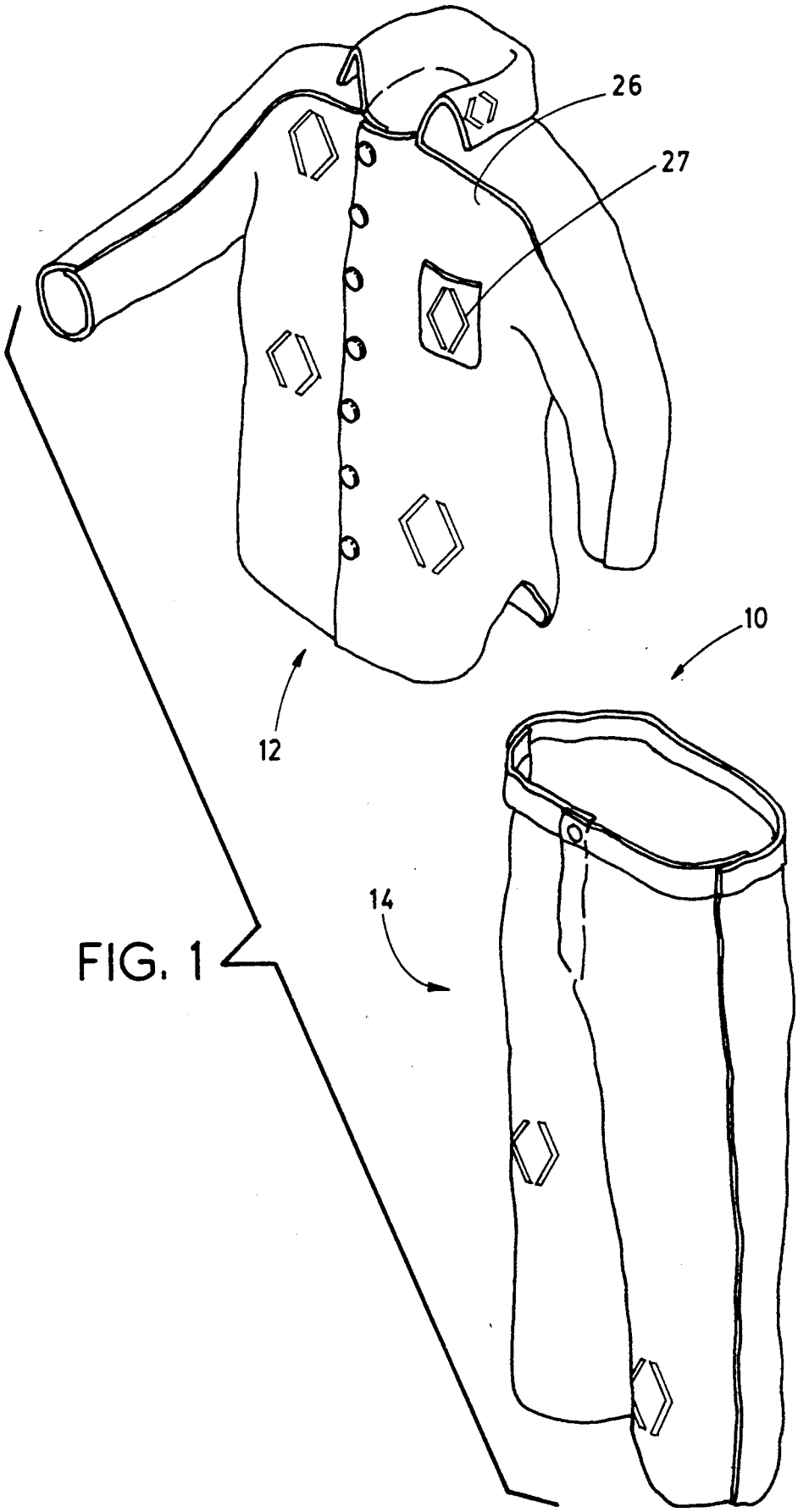
FIG. 1 is a perspective view of the article of clothing embodying the present invention.

Shown in FIG. 1 is an article of clothing 10 which resembles pajamas, yet is intended to be used in a health care situation where a health care provider, such as a doctor or a nurse, must have easy and expeditious access to the patient's body.

The pajamas 10 include a shirt portion 12 and a pants portion 14 which can be formed in an aesthetically pleasing an stylish manner and which are amenable to being worn a plurality of times. The material of the garment can be any suitable material since the garment will be worn several times. The garment is unisex so it is adaptable for use by both men and women.

The shirt 12 is shown in FIGS. 2–9, and includes a body portion 16 having a front section 18 and a rear section 20 and extends from a neck section 22 to a shirttail section 24. The shirt also includes a shoulder section 26 and a pocket 27.

A spread collar 28 is located adjacent to the neck portion, and a placket portion 30 extends in the front section of the shirt from the neck portion to the shirttail portion. A plurality of buttons 32 are fixed to one side of the shirt front section and are engaged with the other portion via button holes to close the shirt about the wearer.

Figure 3:
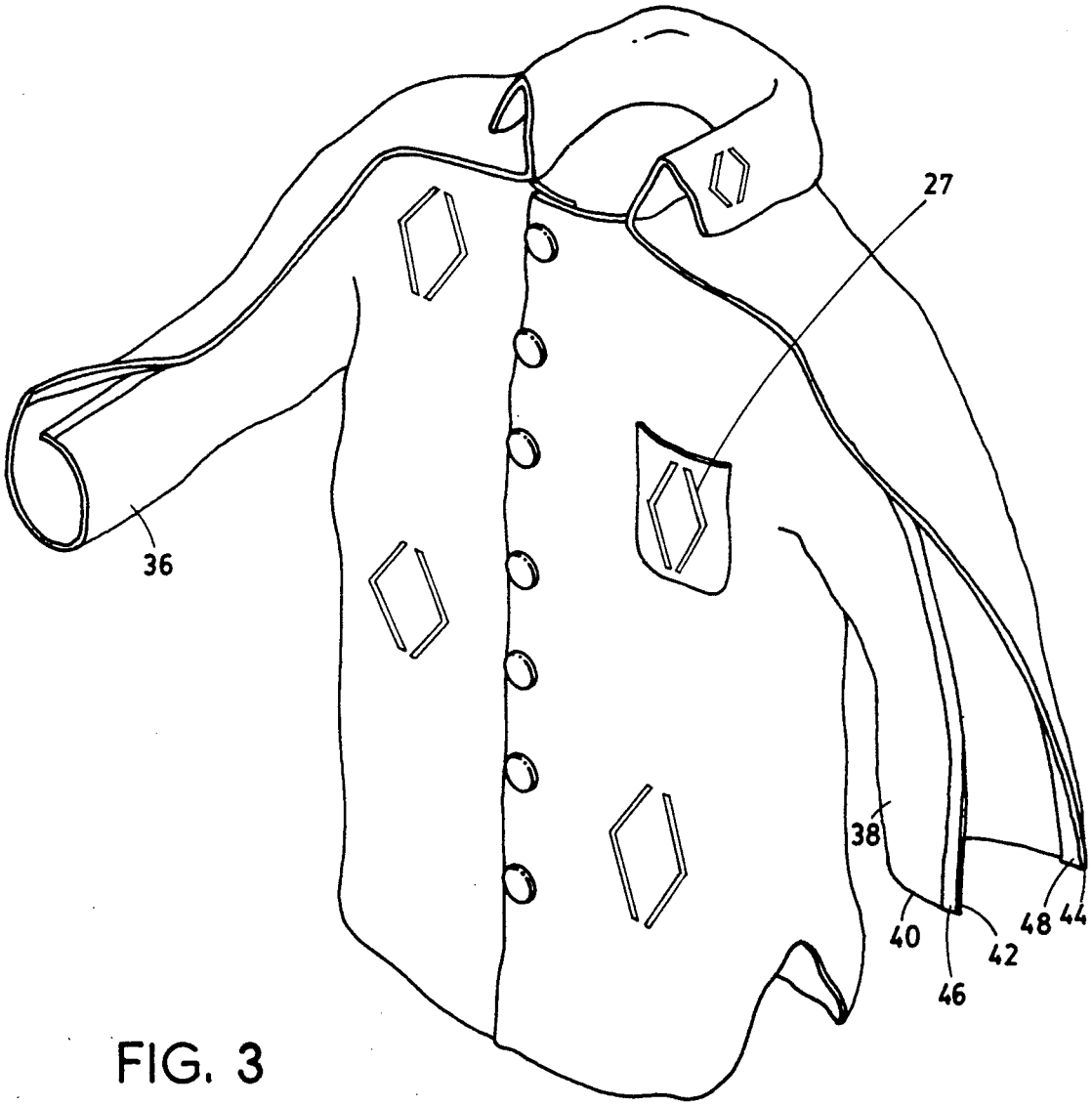
FIG. 3 is a perspective view of the shirt portion with the sleeves thereof partially opened to provide access to the arms of the patient.
Figure 4:
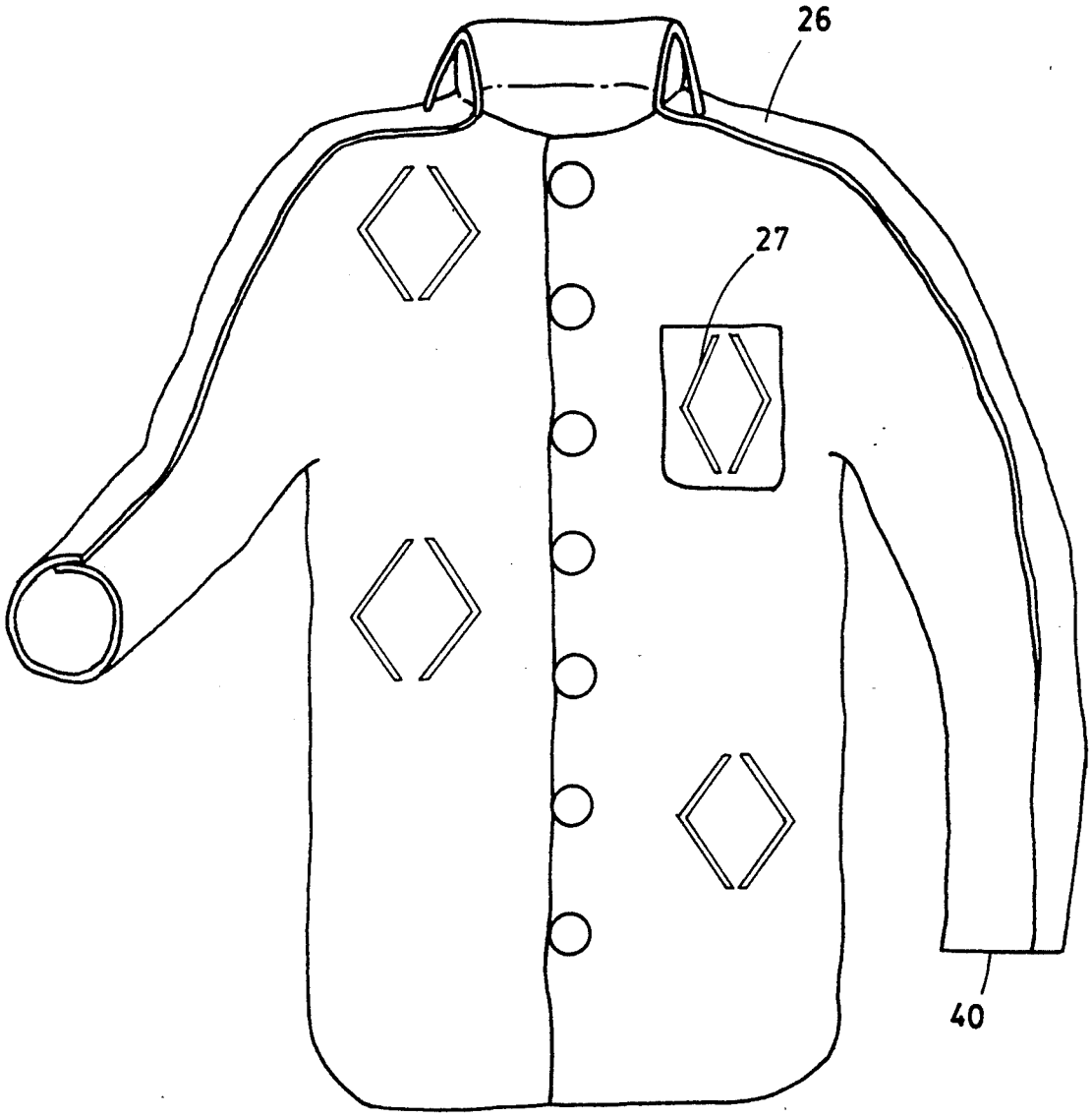
FIG. 4 is a front elevational view of the article of clothing.
Figure 5:
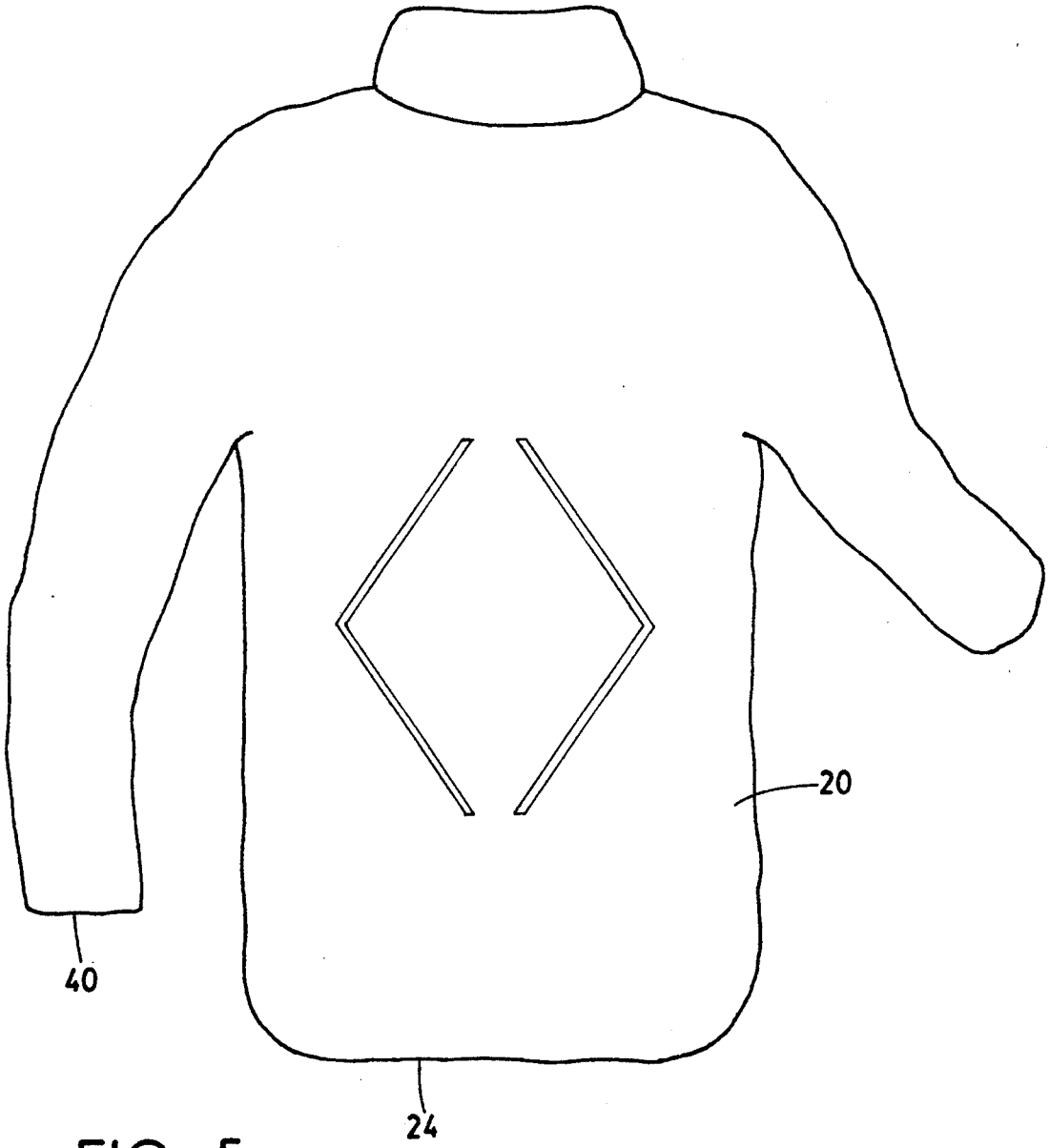
FIG. 5 is a rear elevational view of the shirt.
Figure 6:
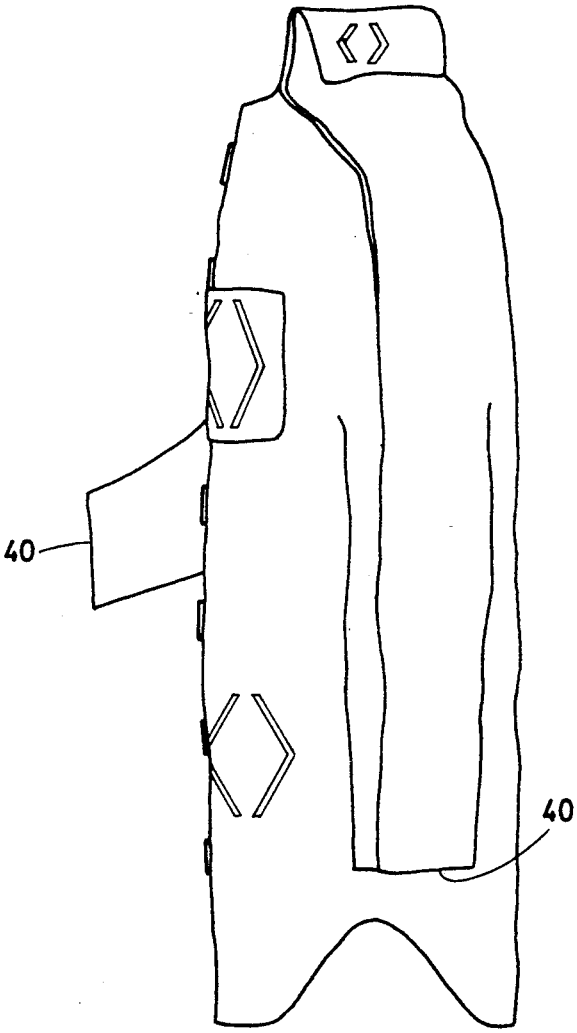
FIG. 6 is side elevational view of the shirt.
Figure 7:
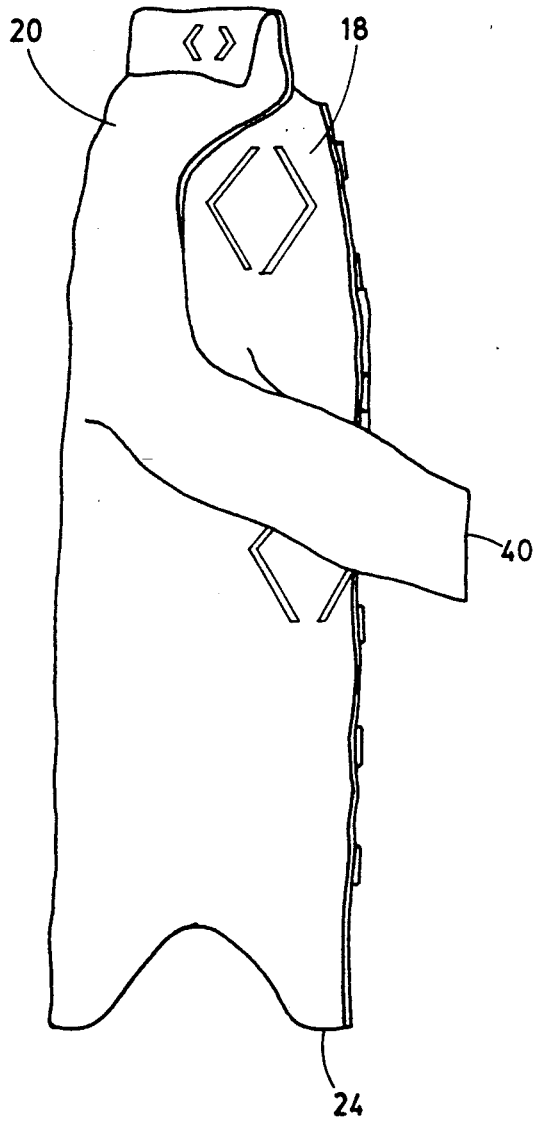
FIG. 7 is side elevational view of the shirt.
Figure 8:
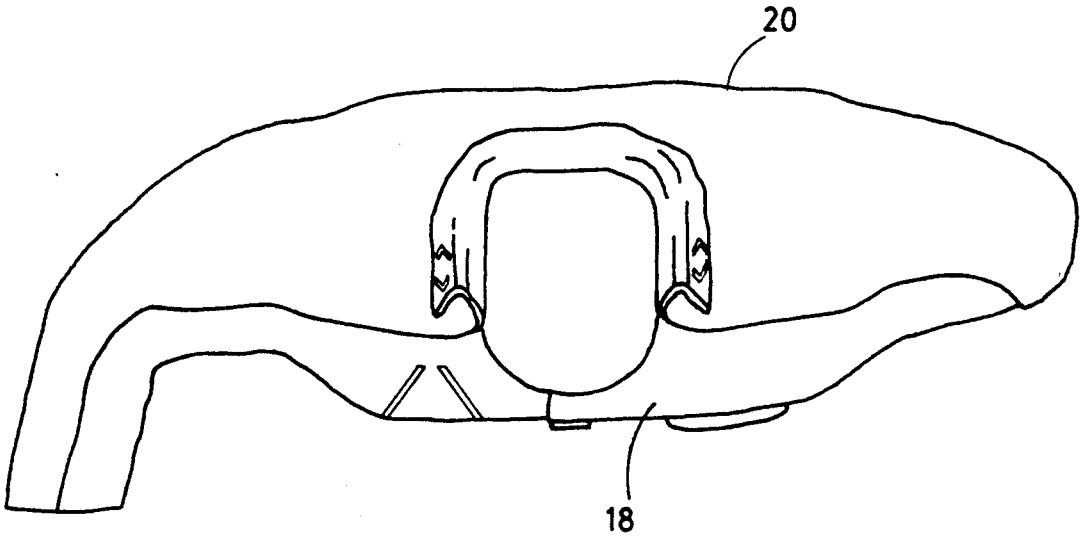
FIG. 8 is a top plan view of the shirt.
Figure 9:
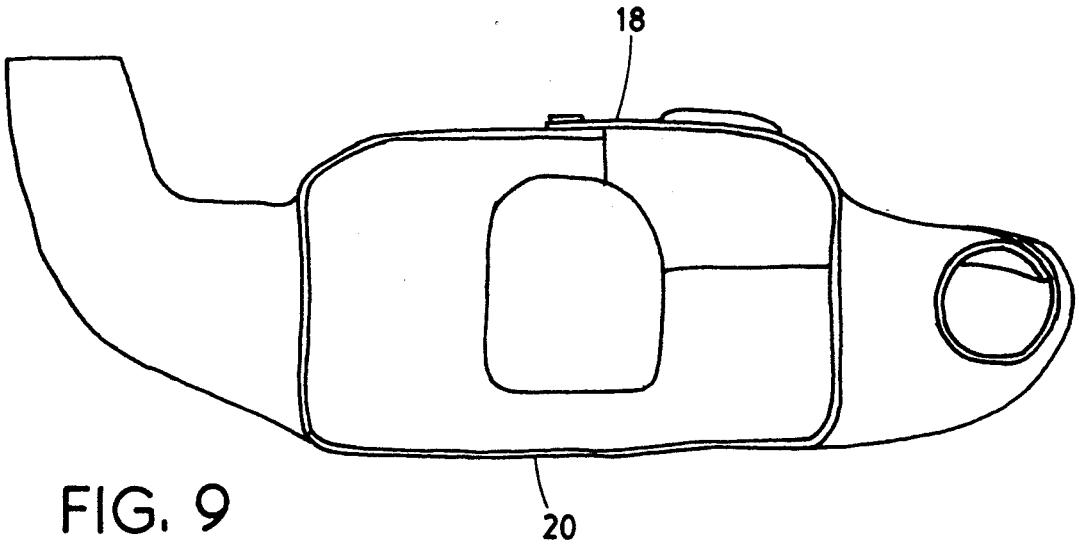
FIG. 9 is a bottom view of the shirt.
Figure 10:
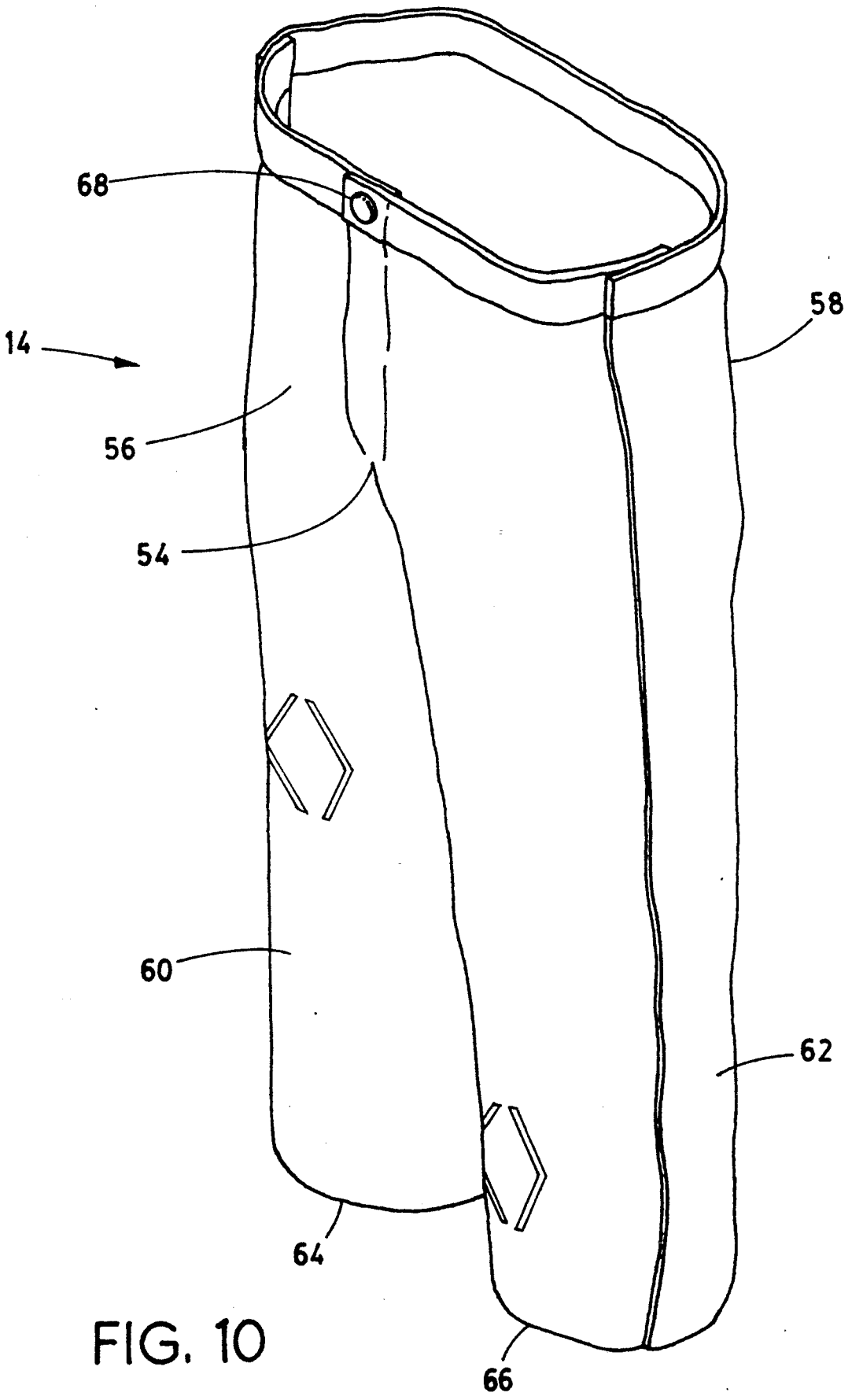
FIG. 10 is a perspective view of the pants portion of the article of clothing of the present invention.

As is best shown in FIG. 3, the shirt also includes two identical sleeves 36 and 38. Each of the sleeves extends from the shoulder portion to a cuff 40 which will be located near a wearer's wrist in use.

As is best shown in FIG. 3, each sleeve is divided into two by an operable seam that includes two ends, such as ends 42 and 44 on sleeve 40 which extend for the entire length of the sleeve from the collar portion of the shirt surrounding a wearer's neck to the cuff portion located adjacent to the wearer's hand. These ends can be separated from each other to define openings of any suitable length for providing access to the wearer's arms, shoulders, chest and back without removing the shirt from the wearer. As indicated in FIG. 3, the ends of each sleeve can be separated from each other for only a short distance along the length of the wearer's arms, or can be separated from each other for the entire distance along the wearer's arms to uncover the arms as well as a portion of the wearer's upper body.

The preferred form of the shirt has the ends 42 and 44 extending in front of the collar portion across the chest of a wearer. This location of the ends permits a health care provider access to the patient if the patient is in a supine position.

Figure 2:
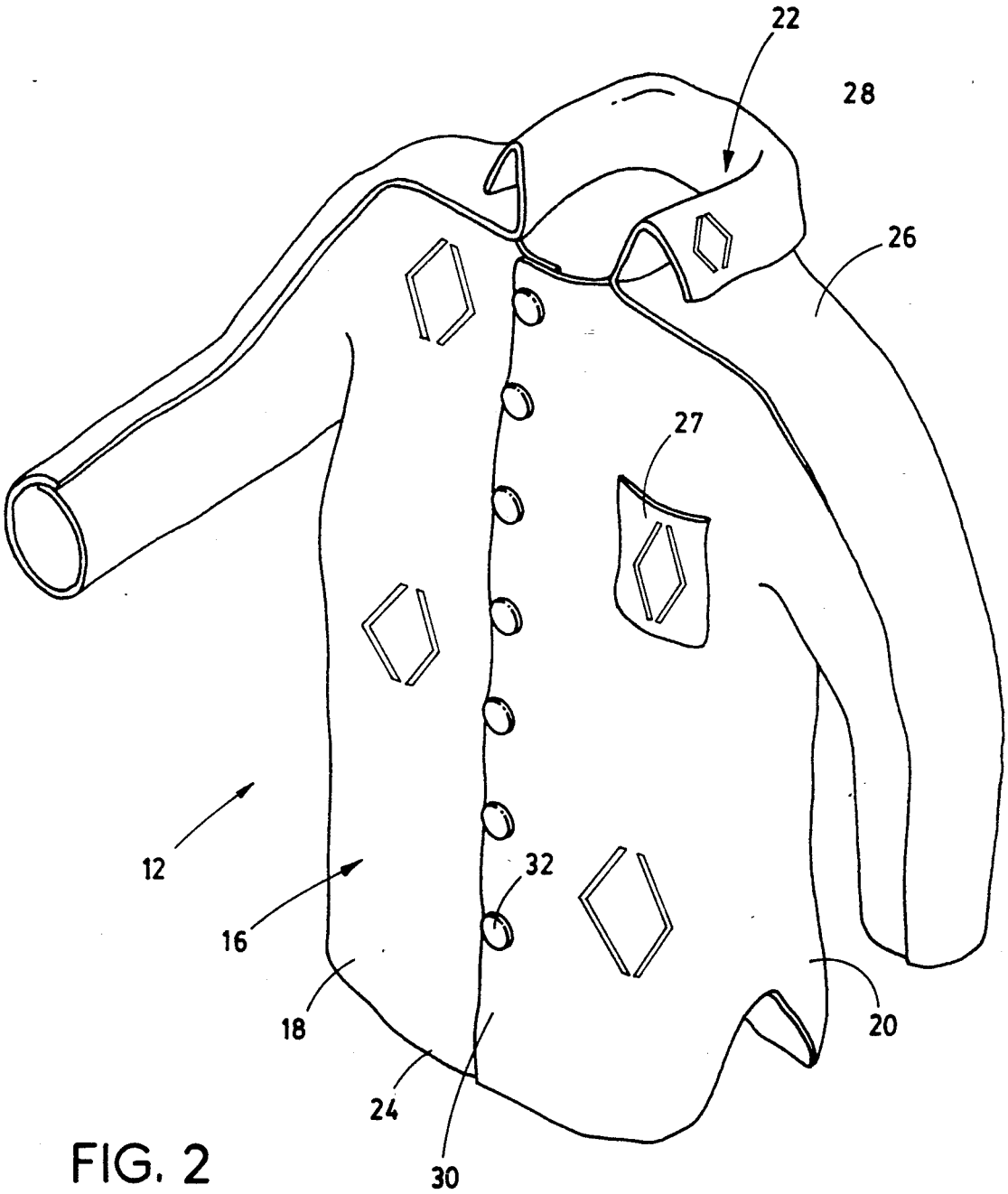
FIG. 2 is a perspective view of a shirt portion of the article of clothing.

The ends 42 and 44 are releasably secured together as shown in FIG. 2, to form a tight fitting garment that can be aesthetically pleasing in appearance and can resemble stylish pajamas. The preferred form of the garment includes fastener means 46 and 48 on each sleeve end 42 and 44 respectively to releasably attach one end to the other. The preferred form of the fastener means includes hook-and-loop fastener means, such as Velcro or the like. However, other forms of fastener means, such as snaps, buttons or zippers can also be used.

The pants 14 are shown in FIGS. 10–17 as including a waistband 50 on one end thereof. A crotch area 52 is located on another area of the pants, with a fly front extending from the crotch area to the waistband in a front section 56 of the pants. The pants also include a rear section 58 covering the buttocks of the wearer.

The pants also include two identical legs 60 and 62 which extend from the waistband to a cuff 64 and 66 on each leg 60 and 62 respectively and located adjacent to a wearer's ankles when the garment pants are being worn. A suitable fastener 68, such as a snap or a button or the like can be used to close one end of the waistband to another end of that waistband.

Figure 11:
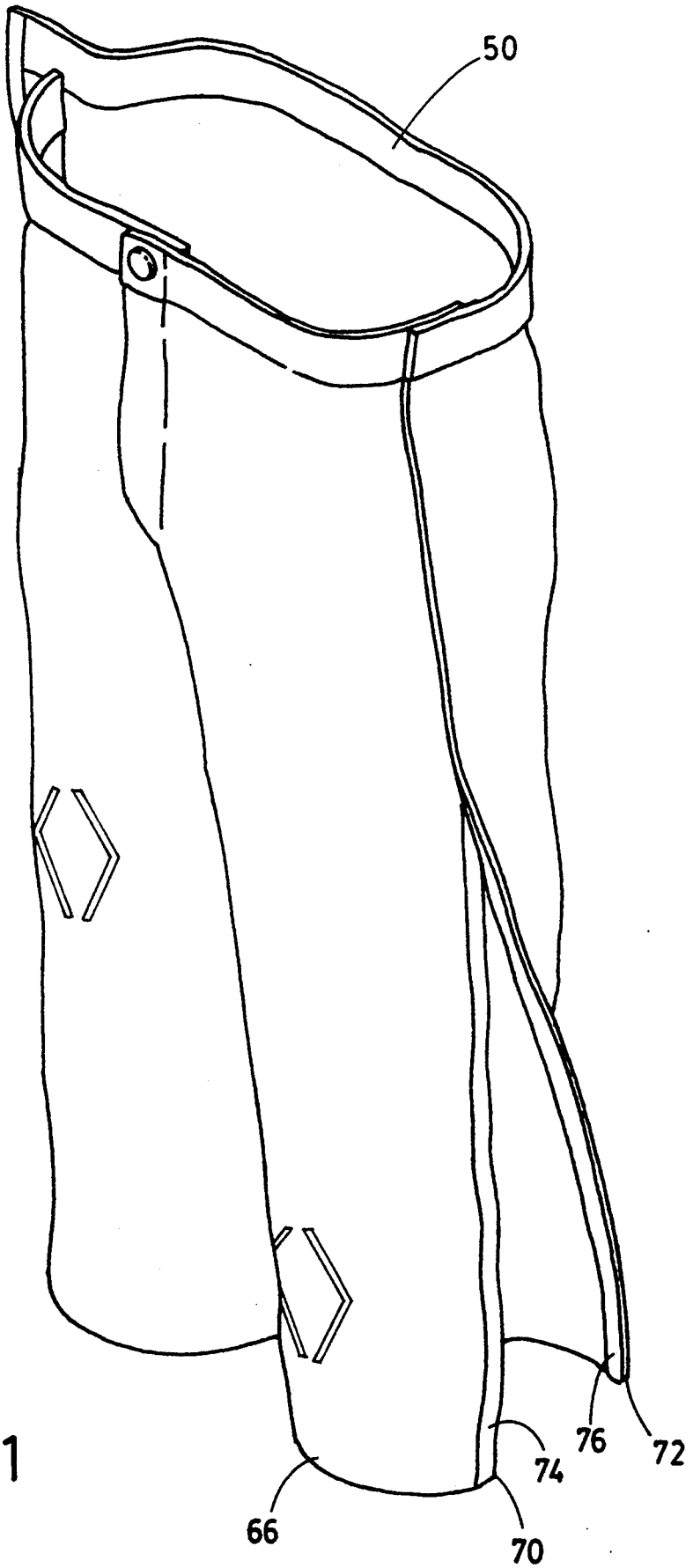
FIG. 11 is a perspective view of the pants in a partially opened configuration to provide access to the wearer's legs and hip area.
Figure 12:
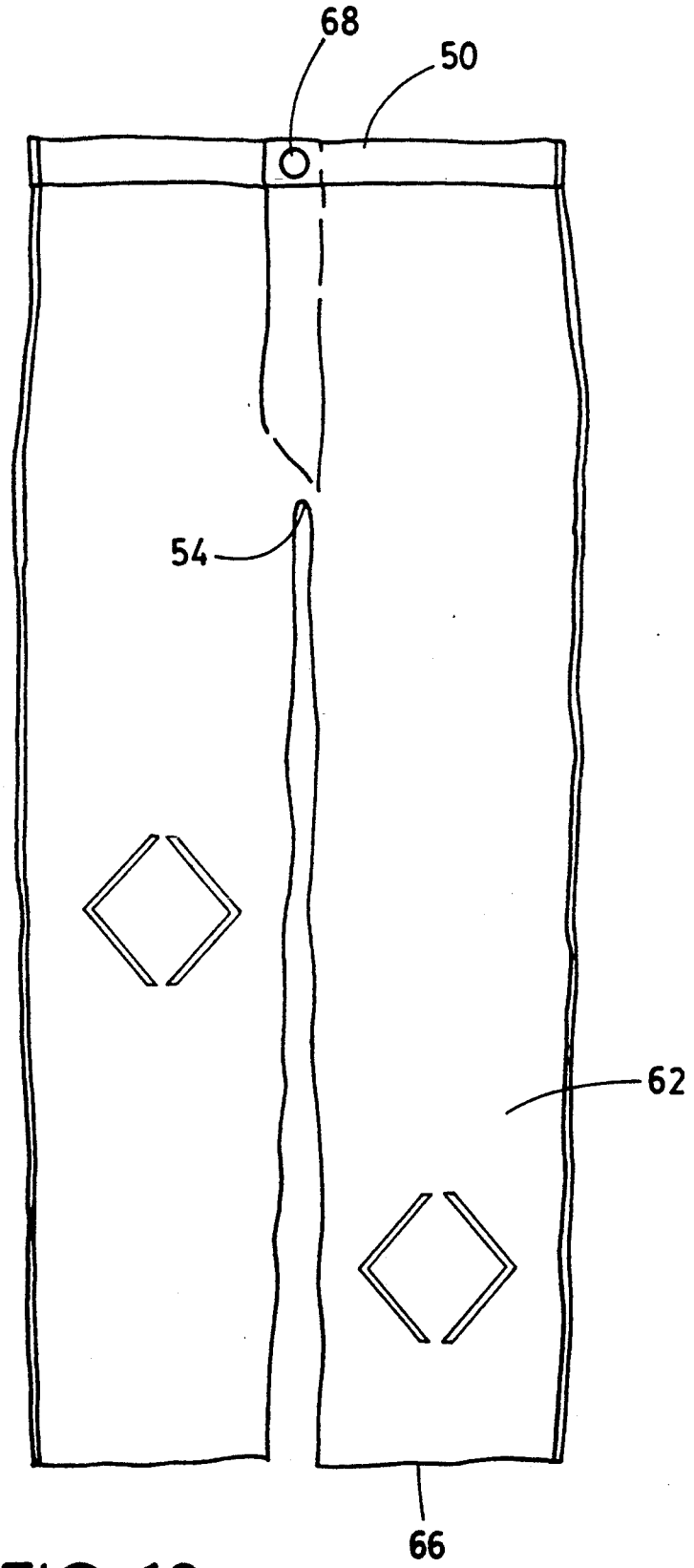
FIG. 12 is a front elevational view of the pants.
Figure 13:
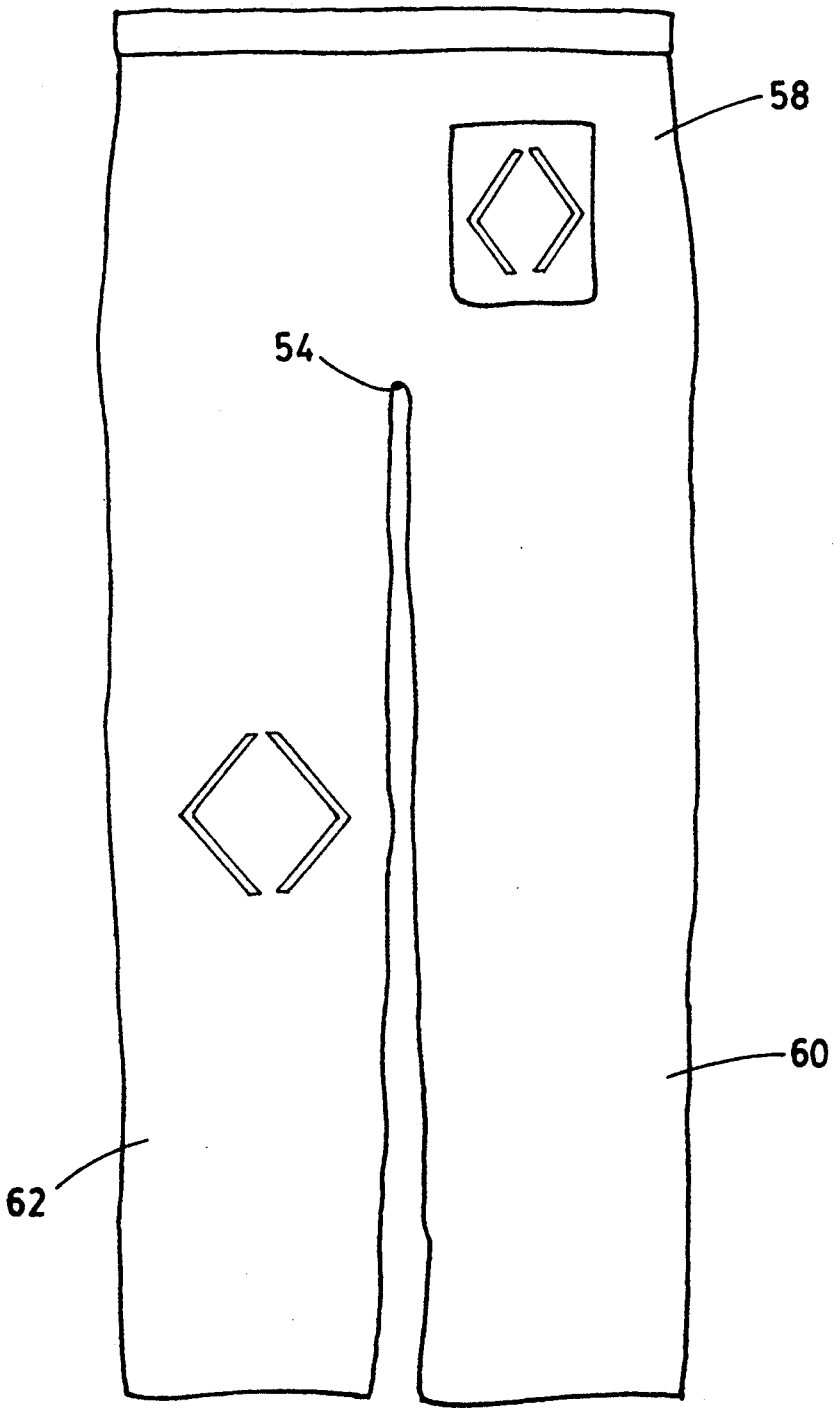
FIG. 13 is a rear elevational view of the pants.
Figure 14:
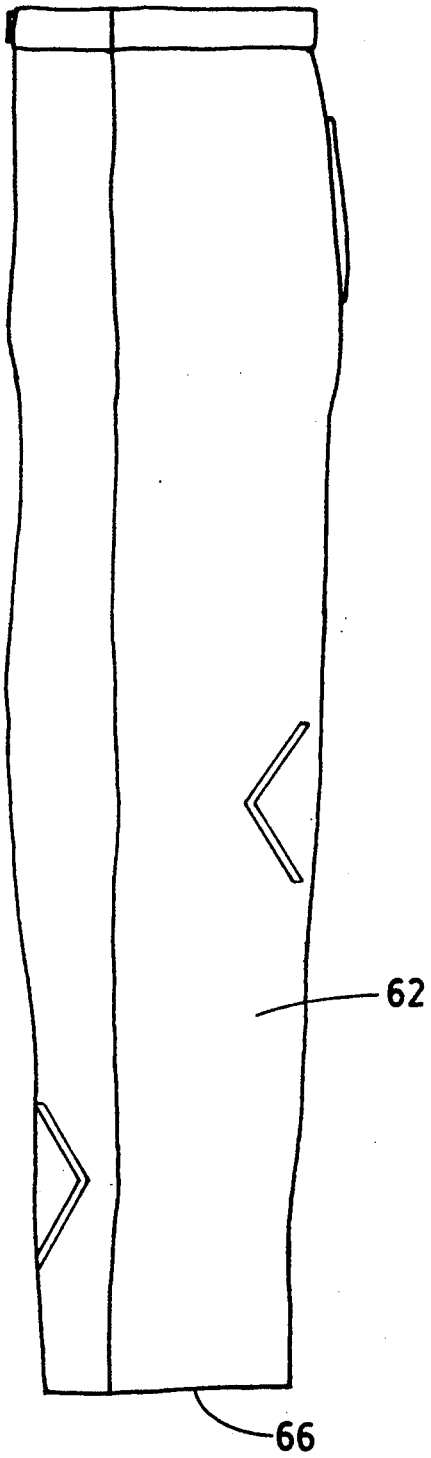
FIG. 14 is a side elevational view of the pants.
Figure 15:
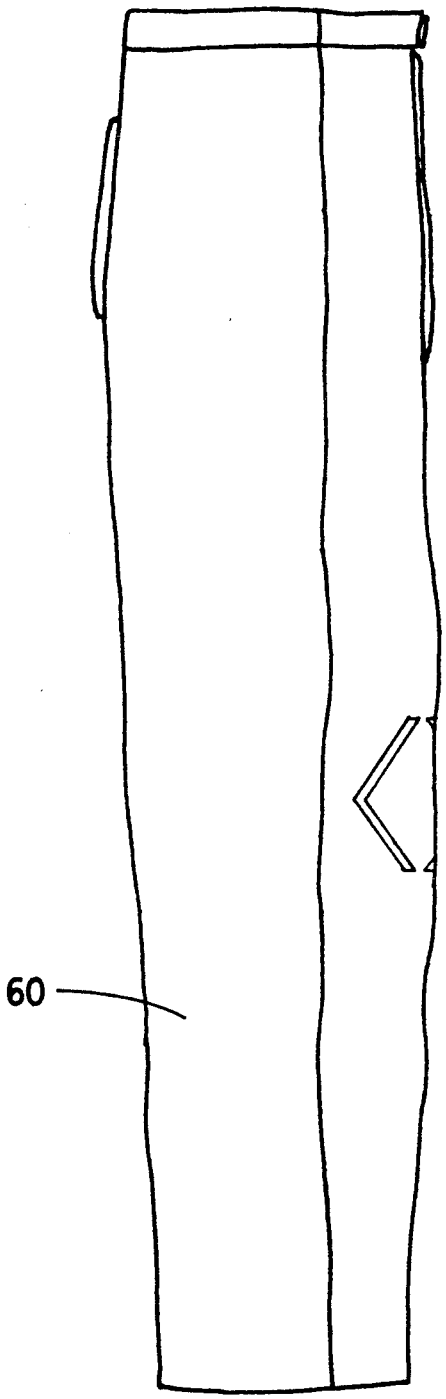
FIG. 15 is a side elevational view of the pants.
Figure 16:
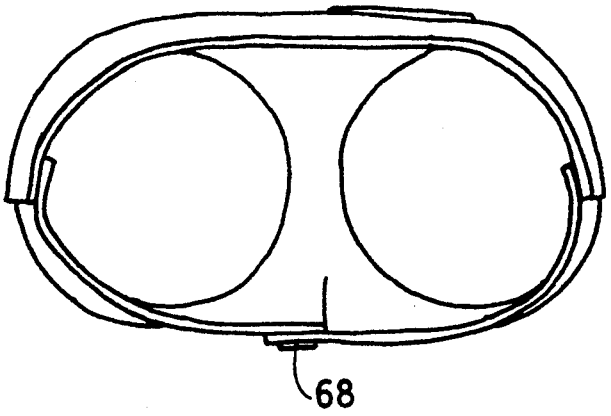
FIG. 16 is a top plan view of the pants.
Figure 17:
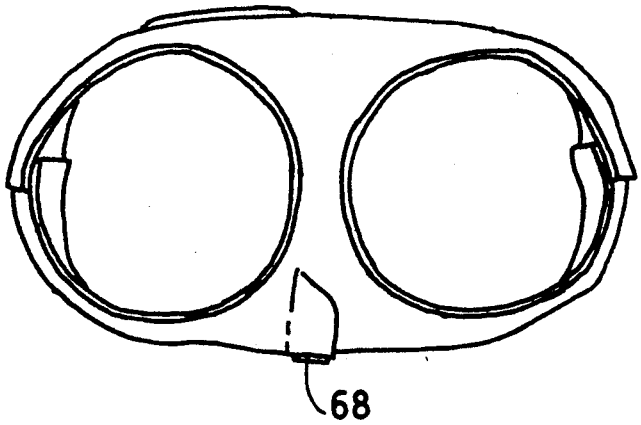
FIG. 17 is a bottom view of the pants.

As is best shown in FIG. 11, each leg includes an operable seam having two ends, such as ends 70 and 72 of leg 66, which extend for the entire length of the leg from the waistband to the cuff so the entire leg can be opened to expose the leg, the hip area, or both, to a health care provider as necessary without requiring the removal of the pants. The pant legs, like the shirt sleeves, can also be partially or totally opened to permit a cast to be accommodated, or to prevent the material of the garment from contacting the wearer.

The ends 70 and 72 are located closer to the front of the pants than to the back section so the closed ends will be more accessible to a health care provider when a patient is in a supine position.

As is the case with the shirt sleeves, the pant leg ends can be releasably fastened together to provide an aesthetically pleasing and stylish garment which can also be warm. The pant leg ends have releasable fastening means, such as fastening means 74 and 76 on leg 66, adjacent to the ends 70 and 72, with the fastening means also extending for the entire length of the legs so the pant legs, like the shirt sleeves, can be partially opened and held in a partially open configuration for as long as necessary. This will permit, for example, an IV set up to be held in place for a great length of time while also permitting the patient to be bathed, and have the garment changed without disturbing the IV set up. The size of the legs or the arms of the garment can also be changed using the separation feature of the garment legs and sleeves.

As is the case of the sleeves, the preferred form of the fastening means includes hook-and-loop fastener means, such as VELCRO, or the like. However, other forms of fastening means, such as zippers, snaps, buttons, or the like can be used to releasably attach one pant leg end to the other as indicated in FIG. 11. As is the case with the shirt, the pants can be made of any suitable material and can be tapered to provide a stylish appearance or the like.

It is understood that while certain forms of the present invention have been illustrated and described herein, it is not to be limited to the specific forms or arrangements of parts described and shown.

We claim:

1. A garment to be worn in a health care situation comprising:

a shirt which includes a body having a front section, a rear section, a shoulder portion that fits on a wearer's shoulders, a top front section that is located on a wearer's collar bone area when the shirt is worn, a neck portion that is located on one end of the shirt body, said neck portion having a front section intersecting said body top front section, said shirt body further including a spread collar adjacent to said neck portion and said shoulder portion, a shirttail on another end of said shirt body, a front placket portion extending along said shirt front section from said neck portion to said shirttail, two identical sleeves, each sleeve extending from said collar at one end thereof to a cuff at another end thereof, each cuff being located adjacent to the wearer's hand when said shirt is being worn, a plurality of button holes defined through said placket portion, a plurality of buttons on said shirt body in position to be received in said button holes;

each sleeve having an openable seam extending for the entire length of each sleeve from said collar to said cuff and being separable to open each shirt sleeve for exposing the wearer's arm to a health care provider, said openable seam of each sleeve intersecting said neck portion front section adjacent to the wearer's collar bone and extending across said shirt body top front section;

fastening means on each sleeve adjacent to said openable seam of each sleeve for releasably closing the openable seam of each sleeve;

a pants portion that includes a front section, a rear section, a waistband on one end thereof, a crotch section extending from said pants portion front section to said pants portion rear section, a fly front extending from said waistband to said crotch section in said pants portion front section, two identical leg sections with each leg section extending from said waistband to a cuff on a bottom and covering a thigh portion of the wearer and the ankle of the wearer, with the cuff of each leg section being located adjacent to the wearer's ankle when said pants portion is worn, each pants portion leg section being tapered with said cuff being tighter about the wearer's ankle than said that portion of the leg portion section adjacent to the thigh of the wearer, each leg portion having an openable seam which extends for the entire length of each leg portion from said waistband to said cuff, said openable seam of each pants portion leg section being separable to provide access to the wearer's legs and hips for providing health care to the wearer, said openable seam of each pants portion leg section being located closer to the front section of the pants portion than to the rear section of the pants portion; and releasable fastening means on each leg section openable seam for releasably closing the openable seam of each leg section.

2. The garment defined in claim 1 wherein said fastening means includes hook-and-loop fastener means.

3. The garment defined in claim 1 wherein said fastening means includes zipper means.

4. The garment defined in claim 1 wherein said fastening means includes button fastening means.

* * * * *